US008157405B1

(12) United States Patent
Schlanger et al.

(10) Patent No.: US 8,157,405 B1
(45) Date of Patent: Apr. 17, 2012

(54) TRAFFIC BARRICADE LIGHT

(76) Inventors: Steven Eric Schlanger, Flagstaff, AZ (US); Scott Allen Clifford, Mesa, AZ (US)

( * ) Notice: Subject to any disclaimer, the term of this patent is extended or adjusted under 35 U.S.C. 154(b) by 452 days.

(21) Appl. No.: 12/368,894

(22) Filed: Feb. 10, 2009

Related U.S. Application Data

(60) Provisional application No. 61/065,770, filed on Feb. 15, 2008.

(51) Int. Cl.
*F21L 4/00* (2006.01)
*F21V 15/00* (2006.01)

(52) U.S. Cl. ..... 362/183; 362/145; 362/362

(58) Field of Classification Search ..... 362/183, 362/145–153.1, 362, 368, 576; 404/6, 16; 340/908.1
See application file for complete search history.

(56) References Cited

U.S. PATENT DOCUMENTS 3,266,015 A * 8/1966 Pickering et al. ..... 340/331
3,500,378 A * 3/1970 Pickering ..... 340/331
3,696,286 A 10/1972 Ule
4,175,249 A 11/1979 Gruber
4,482,941 A * 11/1984 Lindner ..... 362/186
4,604,567 A 8/1986 Chetty
4,626,983 A 12/1986 Harada et al.
4,751,622 A * 6/1988 Williams ..... 362/183
5,342,140 A * 8/1994 Glass ..... 404/9
5,490,045 A * 2/1996 Lindner ..... 362/35
6,768,047 B2 7/2004 Chang et al.
6,914,418 B2 7/2005 Sung
6,984,970 B2 1/2006 Capel
7,030,597 B2 4/2006 Bruno et al.
2005/0128736 A1 * 6/2005 Frick ..... 362/145

* cited by examiner

*Primary Examiner* — Bao Q Truong
(74) *Attorney, Agent, or Firm* — Wright Law Group, PLLC; Mark F. Wright

(57) ABSTRACT

A traffic barricade light is described. A housing comprises a collar, a bottom side, a height, a width and a depth. The housing is divided along an axis positioned within the depth. The housing comprises at least two angled walls on opposing shoulders of the housing within the depth at an oblique angle relative to the bottom side of the housing. Each angled wall comprises a recess and a passage from the recess to a compartment within the housing. A solar panel is coupled to each angled wall. The solar panels are electrically coupled in parallel with each other and with at least one rechargeable battery stored within the housing. A regulator circuit is electrically coupled between the at least two solar panels and the at least one rechargeable battery. A light source is electrically coupled to the battery. A lens is coupled to the collar.

20 Claims, 7 Drawing Sheets

TRAFFIC BARRICADE LIGHT

CROSS REFERENCE TO RELATED APPLICATIONS

This document claims the benefit of the filing date of U.S. Provisional Patent Application 61/065,770 to Schlanger, et al. entitled "Alternative Energy Safety Light," which was filed on Feb. 15, 2008, the disclosure of which is hereby incorporated herein by reference.

BACKGROUND

1. Technical Field

Aspects of the present documents relate generally to traffic barricade lights.

2. Background Art

Traffic barricade lights are commonly used to signal motorists' attention to road construction and repairs, road closures, detours, and the like. Such traffic barricade lights may be placed atop barricades, barriers, cones, barrels, poles, and the like. Traffic barricade lights typically include a base sized to hold D-size batteries, a cover to mount over the top of the base containing various electrical components, and a light source mounted atop the cover within a diffusion lens to broaden the light source beam.

SUMMARY

Aspects of this document relate to gangable electrical boxes.

In one aspect, a traffic barricade light comprises a housing having a collar, a bottom side, a height, a width and a depth, the depth being less than both the height and the width. The housing is separably divided along an axis positioned within the depth. The housing also comprises at least two angled walls on opposing shoulders of the housing within the depth at an oblique angle relative to the bottom side of the housing. Each angled wall comprises a recess and a passage from the recess to a compartment within the housing. At least two solar panels are included, and a solar panel is coupled to each angled wall. The at least two solar panels are electrically coupled in parallel with each other and with at least one rechargeable battery stored within the housing. A regulator circuit is electrically coupled between the at least two solar panels and the at least one rechargeable battery. In addition, a light source is electrically coupled to the battery. A lens is coupled to the collar.

Particular implementations may include one or more of the following. The housing may be separably divided at a midpoint of the depth. The housing may comprise a front side and a back side, and the front side may be separably coupled with the back side via at least one fastener passing through both the front side and the back side. The front side and the back side may each comprise an external wall, a plurality of internal walls extending within the housing from the front side to the back side of the housing, and a plurality of tabs extending from the plurality of internal walls, the plurality of tabs corresponding with a plurality of notches in the plurality of internal walls such that when the front side of the housing is mated with the back side of the housing, wherein the plurality of tabs each mates with its corresponding notch of the plurality of notches. At least two of the plurality of tabs are oriented in a different direction from one another. The plurality of internal walls may define a battery cavity. One of the at least two solar panels may be coupled within the recess. A lens depth and the housing depth may be substantially equal.

In another aspect, a housing assembly for a traffic barricade light battery comprises a housing having a collar, a bottom side, a front side, a back side, a height, a width and a depth, the depth being less than both the height and the width. The housing is separably divided along an axis positioned within the depth. The housing comprises at least two angled walls on opposing shoulders of the housing within the depth at an oblique angle relative to the bottom side of the housing. Each angled wall comprises a recess and a passage from the recess to a compartment within the housing. The front side and the back side each comprise an external wall, a plurality of internal walls extending within the housing from the front side to the back side of the housing, and a plurality of tabs extending from the plurality of internal walls, the plurality of tabs corresponding with a plurality of notches in the plurality of internal walls such that when the front side of the housing is mated with the back side of the housing, wherein the plurality of tabs each mates with its corresponding notch of the plurality of notches.

Particular implementations may include one or more of the following. At least two of the plurality of tabs may be oriented in a different direction than one another. The housing may be separably divided at a midpoint of the depth. The front side may be separably coupled with the back side via at least one fastener passing through both the front side and the back side. The plurality of internal walls may define a battery cavity. At least two solar panels may be included, and each of the at least two solar panels may be disposed within a recess on each of the at least two angled walls.

In still another aspect, a traffic barricade light comprises a housing having a collar, a bottom side, a height, a width and a depth, the depth being less than both the height and the width, wherein the housing is separably divided along an axis positioned within the depth. The housing comprises a recess and a passage from the recess to a compartment within the housing. At least two solar panels are electrically coupled in parallel with each other and with at least one rechargeable battery stored within the housing. A light source is electrically coupled to the battery. A lens is coupled to the collar.

Particular implementations may include one or more of the following. The compartment may comprise a plurality of interlocking tabs, at least two of the plurality of interlocking tabs oriented in a different direction than one another. A regulator circuit may be electrically coupled between the at least two solar panels and the at least one rechargeable battery. The housing may comprise at least two angled walls on opposing shoulders of the housing within the depth at an oblique angle relative to the bottom side of the housing. The recess may be disposed within each of at least two angled walls on opposing shoulders of the housing, the at least two angled walls located within the depth at an oblique angle relative to the bottom side of the housing. The front side and the back side may each comprise an external wall, a plurality of internal walls extending within the housing from the front side to the back side of the housing, and a plurality of tabs extending from the plurality of internal walls, the plurality of tabs corresponding with a plurality of notches in the plurality of internal walls such that when the front side of the housing is mated with the back side of the housing, wherein the plurality of tabs each mates with its corresponding notch of the plurality of notches. Also, the plurality of internal walls may define a battery cavity.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

A gangable electrical unit will hereinafter be described in conjunction with the appended drawings, where like designations denote like elements, and.

DESCRIPTION

This disclosure, its aspects and implementations, are not limited to the specific components or assembly procedures disclosed herein. Many additional components and assembly procedures known in the art consistent with the intended operation and/or assembly procedures for a traffic barricade light will become apparent for use with implementations of barricade lights from this disclosure. Accordingly, for example, although particular traffic barricade lights, housings, collars, bottom sides, heights, widths, depths, axes, angled walls, opposing shoulders, recesses, passages, compartments, solar panels, rechargeable batteries, regulator circuits, light sources, lenses, interlocking tabs, tabs, notches, front sides, back sides, external walls, internal walls, tabs, battery cavities, barricades, charger bases, and implementing components are disclosed, such may comprise any shape, size, style, type, model, version, measurement, concentration, material, quantity, and/or the like as is known in the art for such traffic barricade lights, consistent with the intended operation of a traffic barricade light.

Figure 1:
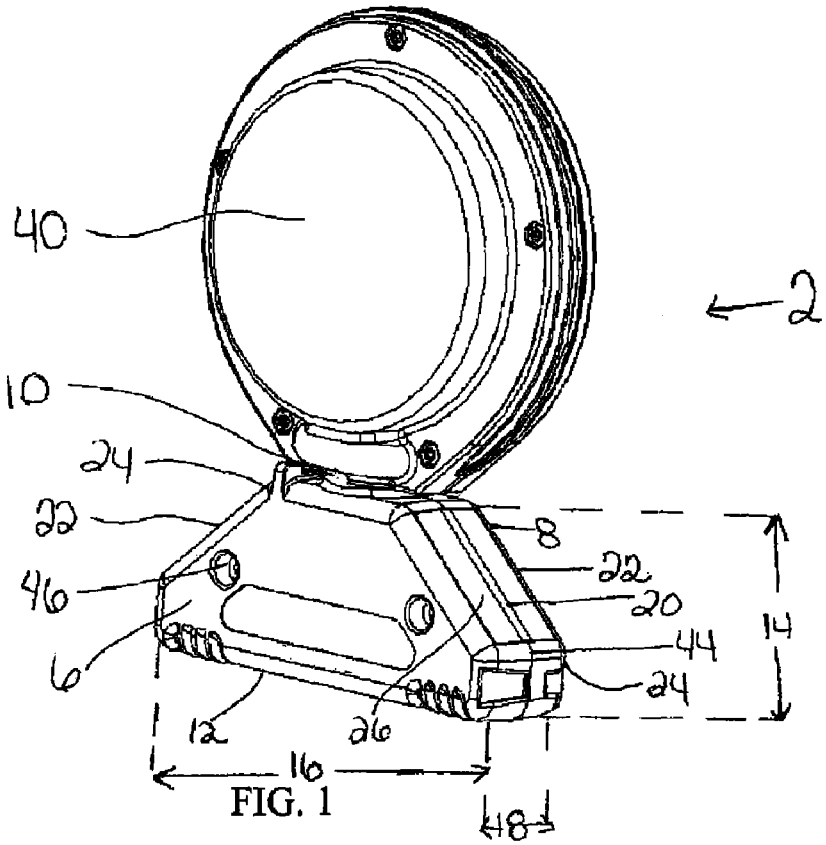
FIG. 1 illustrates an assembled perspective view of a first particular implementation of a traffic barricade light.

There are a variety of traffic barricade light implementations. FIG. 1 illustrates a first particular implementation of an assembled traffic barricade light. The traffic barricade light 2 includes a housing 4 formed by the separatable coupling of a front side 6 and a back side 8 (described further with respect to FIGS. 2-4). Once formed, the housing 4 comprises a collar 10, a bottom side 12, a height 14, a width 16, and a depth 18. As illustrated, the depth 18 is less than both the height 14 and the width 16. The housing 4 is separably divided along an axis 20 (a plane along which the front side 6 and the back side 8 are joined together), which is positioned within the depth 18. In some particular implementations, the axis 20 is located at a midpoint 44 of the depth 18 such that the housing 4 is separably divided at the midpoint 44 of the depth 18 of the housing 4. Although division at the midpoint 44 of the depth 18 is not required, if division is made at the midpoint 44 and the front side 6 and the back side 8 are properly configured, as is the case in the implementation illustrated in FIG. 3, the front side 6 piece and the back side 8 piece can be formed as identical pieces that mate when positioned face-to-face. This significantly simplifies the manufacturing process.

Figure 2:
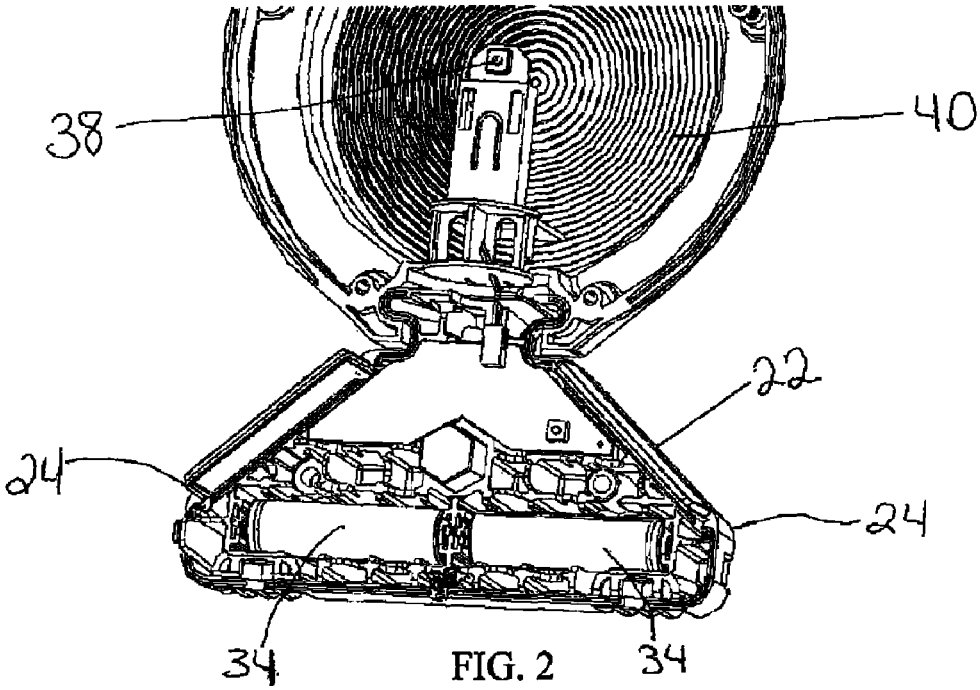
FIG. 2 is a cutaway front view of the implementation of FIG. 1 with an upper portion of the lens not shown.
Figure 3:
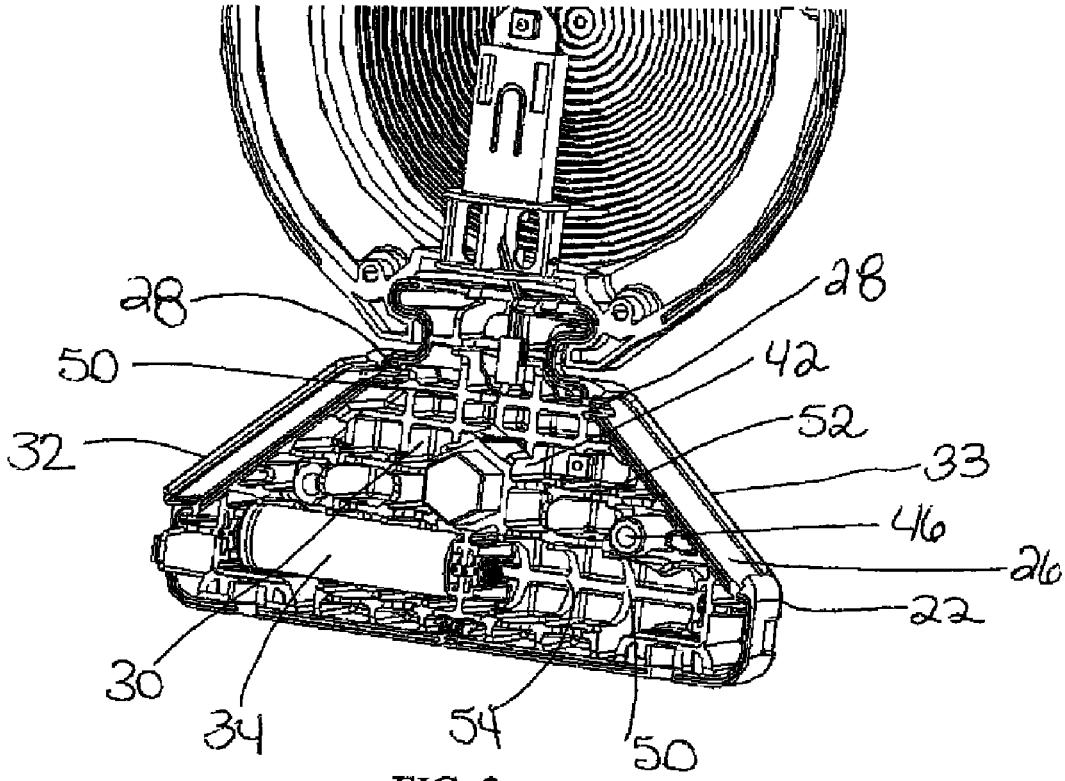
FIG. 3 is a cutaway perspective view of the implementation of FIG. 1 with an upper portion of the lens not shown.

Referring now to FIGS. 1-3, the housing 4 further comprises at least two angled walls 22 positioned within the depth 18 and located on opposing shoulders 24 of the housing 4. Significantly, the angled walls 22 are positioned at an oblique angle (that is, not 90° and not 180°) with respect to the bottom side 12 of the housing 4. In some particular implementations, the angled walls 22 are positioned at about 45° with respect to the bottom side 12 of the housing 4. In the particular implementation shown, though it is not required, each of the at least two angled walls 22 may comprise a recess 26 and a passage 28 from the recess to a compartment 30 within the housing 4. Some particular implementations of a barricade light may not comprise a recess 26 (although such implementations may, nevertheless, have a passage 28 from an external portion of the housing 4 to an internal compartment 30 within the housing 4).

Figure 11:
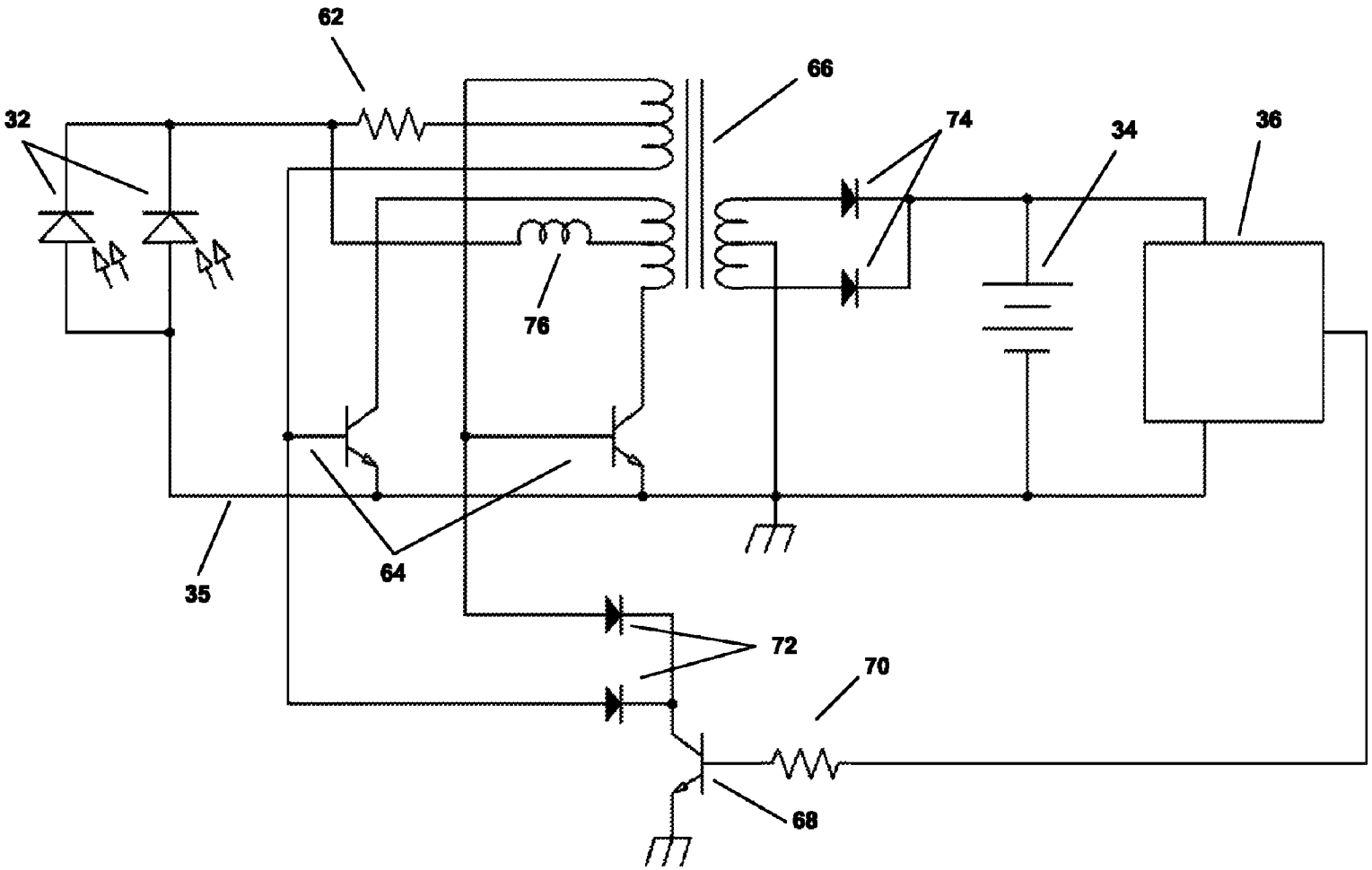
FIG. 11 is a circuit diagram of the implementation of FIG. 1.

Referring still to the particular implementation shown in FIGS. 1-3, a traffic barricade light 2 may include at least two solar panels 32 (the parallel combination of two or more solar panels 32 represented in FIG. 11 by a single symbol) each coupled to an angled wall 22. Those having ordinary skill in the art will be able to select appropriate solar panels for use with the particular implementations of traffic barricade light described herein. When the solar panels 32 are coupled with the angled walls 22, the solar panels will themselves be oriented obliquely (between about 35° and 55° in some particular implementations) with respect to the bottom side 12. Angling the angled walls 22 at an angle in the range around 45° helps to maximize daily sun exposure for the two opposing, fixed position solar panels. Significantly, as a day progresses, the sun moves through the sky, from east to west. At the beginning of the day, the sun rises from behind the eastern horizon, moving overhead as the day progresses, finally nearing and setting behind the western horizon at the end of the day. By orienting the solar panels 32 obliquely and in different directions, as opposed to orienting them in the same direction and parallel, with respect to the bottom side 12 of the housing 4, more sunlight charge energy may be captured at the beginning and the end of the day regardless of the exact polar position of the barricade with respect to the rising and setting sun than if the solar panels were oriented in the same direction and parallel to the bottom side 12 of the housing 4. In addition, loss of sunlight charge energy capture occurring during the middle of the day due to the oblique orientation of the solar panels 32, since at least one and usually both of the solar panels is not directly facing the sun at any one point in time throughout the day, are offset by additional gains at the beginning and end of day. Furthermore, the oblique orientation of the at least two solar panels 32 may effectively lengthen the charging length of a day since sunlight energy may be more efficiently captured both early and late in the day, when the sun is closest to the eastern and western horizons, respectively, and which might not be captured as efficiently if the at least two solar panels 32 were oriented in the same direction and parallel to the bottom side 12.

At some point during the day, at least a portion of the at least two solar panels 32 is at least partially shaded at least by the housing 4 and/or lens 40. For example, when the traffic barricade light 2 is oriented such that the at least two solar panels 32 are in an east-west facing orientation, and when it is early in the day (with the sun comparatively near to the eastern horizon), the eastward-facing solar panel 32 may be in direct sunlight, although the westward-facing solar panel 32 will be at least partially shaded at least by the housing 4 and/or lens 40. Conversely, when it is late in the day and the sun is comparatively near to the western horizon, the westward-facing solar panel 32 may be in direct sunlight, although the eastward-facing solar panel 32 will be at least partially shaded by at least the housing 4 and/or lens 40. In any event, an operator may position traffic barricade light 2 such that the at least two solar panels are in a north-south orientation, or in an east-west orientation. Whether traffic barricade light 2 is positioned in a north-south orientation, or in an east-west orientation, or in some other orientation, by orienting the solar panels 32 obliquely and in different directions, as opposed to orienting them in the same direction and parallel, combined with electrically coupling the solar panels 32 in parallel, the charge energy that can be stored from the at least two solar panels 32 can be maximized throughout the day. Therefore, there is no requirement that an operator position this particular implementation of the traffic barricade light 2 in any particular orientation to take advantage of the solar power.

In some particular implementations, a solar panel 32 may be coupled within a recess 26 such that an upper surface 33 of the solar panel 32 is substantially flush with or just slightly below the top surface of the angled wall 22. This arrangement may be particularly useful to protect the solar panels 32 in the event that traffic barricade light 2 is knocked to the ground, or the housing 4 is otherwise subjected to abuse such as being run over by a motorized vehicle or equipment, being impacted by tools or debris, and/or other physical assaults.

The at least two solar panels 32 may be electrically coupled with one another in a parallel arrangement. In addition, the solar panels 32 are likewise coupled in parallel with at least one rechargeable battery 34 stored within the housing 4. Those having ordinary skill in the art will be able to select one or more appropriate rechargeable batteries for use with particular implementations of traffic barricade light described herein. In particular, the solar panels 32 are in electrical communication with a rechargeable battery 34 via one or more electrical connectors 35 which, in particular implementations, may pass through a passage 28. In the particular implementation shown, a regulator circuit 36 is coupled between the solar panels 32 and the at least one rechargeable battery 34.

As described above, neither of the at least two solar panels 32 will be directly facing the sun at the same time in the day, and it is possible that neither of the at least two solar panels 32 will directly face the sun at any time during the day. Accordingly, the at least two solar panels 32, collectively, operate below their maximum possible charging capacity throughout the course of the day. The regulator circuit 36 regulates the maximum operating point between the solar panels 32 and the at least one rechargeable battery 34 such that an optimum charge power is achieved throughout the day as the at least one rechargeable battery 34 is charged (described further below with respect to FIG. 10). Those having ordinary skill in the art will be able to select an appropriate regulator circuit for use with particular implementations of a traffic barricade light and desired charging characteristics from the disclosure provided herein. In addition to the foregoing, the traffic barricade light 2 comprises a light source 38 in electrical communication with the at least one rechargeable battery 34 via one or more electrical connectors 35. In some particular implementations, the light source 38 may comprise any incandescent, fluorescent, halogen, arc, and/or any other lamp or bulb. In other particular implementations, the light source 38 may comprise a Light-Emitting Diode (LED), or other electroluminescent device.

Now referring to FIGS. 1-5, the traffic barricade light 2 comprises a lens 40. The lens 40 is coupled with the housing 4 via the removable and/or breakaway attachment of the lens 40 to the collar 10 of the housing 4. The lens 40 may comprise any transparent or translucent cover for the light source 38. In some particular implementations, the lens 40 may comprise a reflective lens such that the distribution of light emitted from the light source 38 is diffused and/or widened so as to increase its visibility. In any event, due at least to cost considerations, the lens 40 is designed to break away easily from the housing 4 if the barricade is run over by a vehicle or other bending force is applied between the housing 4 and the lens 40.

The housing 4 contains most of the comparatively expensive components defining a traffic barricade light 2 such as, by way of non-limiting example, the at least two solar panels 32, the at least one rechargeable battery 34, and the regulator circuit 36. By contrast, the lens 40 is relatively inexpensive to make and relatively quick to install/replace. Accordingly, in cases where the traffic barricade light 2 is run-over by a car, for example, the lens 40 will most likely be destroyed. By configuring the lens 40 with breakable plastic materials and a relatively weak connection between the lens 40 and the collar 10 of the housing 4, the lens crushes and/or separates from the housing if it is run over by a vehicle or hit with a sudden force. In addition, in particular implementations, the depth of the lens 40 is substantially the same as the depth 18 of the housing 4, such that when a traffic barricade light 2 is run over by a motor vehicle, for instance, the lens 40 may be crushed, but the housing 4 may remain flat on the ground surface, resisting torque on the collar 10 and the sheer force across the body of the housing that is generally caused when a vehicle runs over a conventional barricade light assembly. Furthermore, the fortification of the housing 4 through at least a plurality of internal walls 50 and the mechanical cooperation of tabs 42 and notches 52, as described further below, increases the comparative durability of the collar 10 and housing 4 with respect to the lens 40.

As noted above, traffic barricade lights, such as the traffic barricade light 2, may be subjected to abuse during their normal course of operation. Specifically, in some instances, by way of non-limiting example, the traffic barricade light 2 may be run over by a motorized vehicle or equipment. In some particular implementations of a traffic barricade light, the housing 4 is made crush-resistant due at least to the presence of a plurality of internal walls 50 that extend from the front side 6 to the back side 8 of the housing 4.

In particular, both the front side 6 and the back side 8 of the housing 4 comprise an external wall 48. A plurality of internal walls 50 extend both from the external wall 48 of the front side 6, as well from the external wall 48 of the back side 8 (see FIG. 4). It will be understood that the plurality of internal walls 50 on the front side 6 correspondingly align with the plurality of internal walls 50 on the back side 8 to form a continuous wall. Accordingly, the combination of the front side 6 internal walls 50 and the corresponding and aligning back side 8 internal walls 50 result in a plurality of internal walls 50 that extend all the way from the external wall 48 of the front side 6 to the external wall 48 of the back side 8. In the particular implementations where one or more of the front side 6 internal walls 50 mates with one or more corresponding and aligning back side 8 internal wall to form a joint 49, an even stronger resistance to crushing force is formed. Specifically, with housing 4 positioned on the ground such that the external wall 48 of the front side 6 (or back side 8) is in contact with the ground, when a crushing force is applied to the external wall 48 of the other side (the front side 6 or the back side 8), the plurality of internal walls 50 provide structural resistance against the crushing together of the front side 6 and the back side 8.

In some particular implementations, the plurality of internal walls 50 may define a through aperture 46 to allow the passage therethrough of a fastener such as, by way of non-limiting example, a screw or bolt. In such particular implementations, the fastener may pass through both front side 6 and back side 8. In other particular implementations, the plurality of internal walls 50 may define a battery cavity, such as the battery cavity 54, or an internal compartment, such as the compartment 30. In still other particular implementations, the plurality of internal walls 50 may define any internal curvilinear or rectilinear shape when viewed in cross section such as, by way of non limiting example, circular, triangular, square, rectangular, pentagonal, hexagonal, heptagonal, octagonal, nonagonal, decagonal, or the like.

In addition to the crush-resistance of housing 4 described above, in some particular implementations of a traffic barricade light, the housing 4 (including the collar 10) may be made shear-stress resistant. Shear-stress or shear-force refers to sliding or transversely-acting forces, such as the force applied by opposing blades of a pair of scissors while cutting a piece of paper. Frequently, when traffic barricade lights (such as traffic barricade light 2) are run over by a motor vehicle or other equipment, shearing forces are applied to the housing 4 such that the front side 6 and the back side 8 are forced in different directions. Specifically, as the tire or tires of a vehicle rolls over the housing 4, the side in contact with the ground (either the front side 6 or the back side 8) may tend to remain stationary due at least to a the weight of the vehicle pressing down, as well as friction between that side of the housing 4 and the ground. By contrast, a rolling tire may contact the side of housing 4 that faces skyward (whichever of the front side 6 and the back side 8 that is not in contact with the ground), thereby laterally pushing or pulling the skyward-facing side of the housing 4 (depending upon the direction of approach and/or rotation of the tire) with respect to the side of the housing 4 that is in contact with the ground. Accordingly, one non-limiting example of a shear-force may occur where a traffic barricade light 2 is run over by a motor vehicle.

Figure 4:
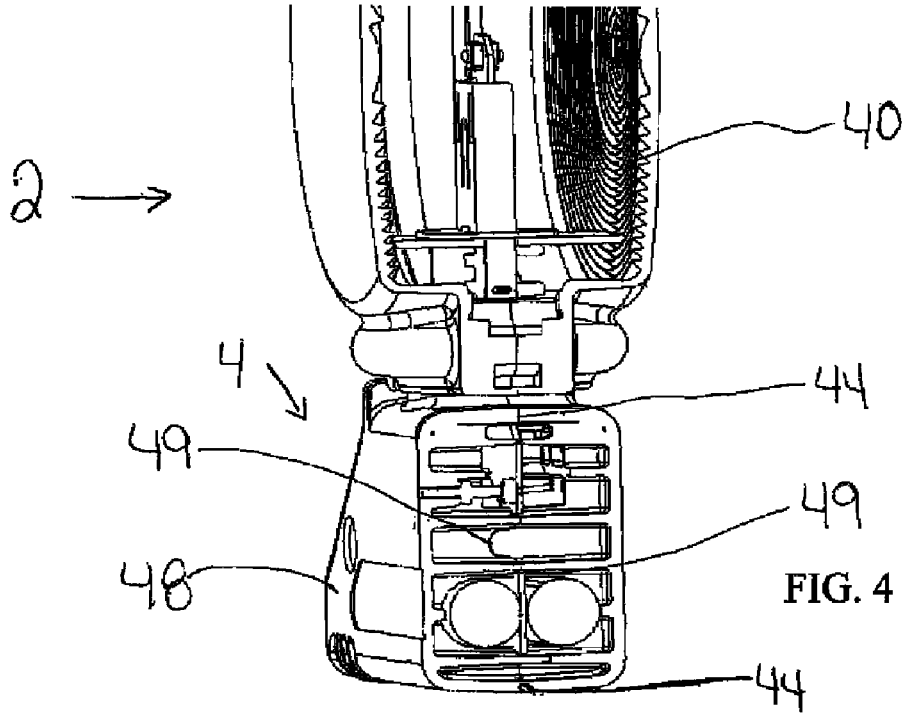
FIG. 4 is a cross-sectional view of the implementation of FIG. 1 with an upper portion of the lens not shown.
Figure 5:
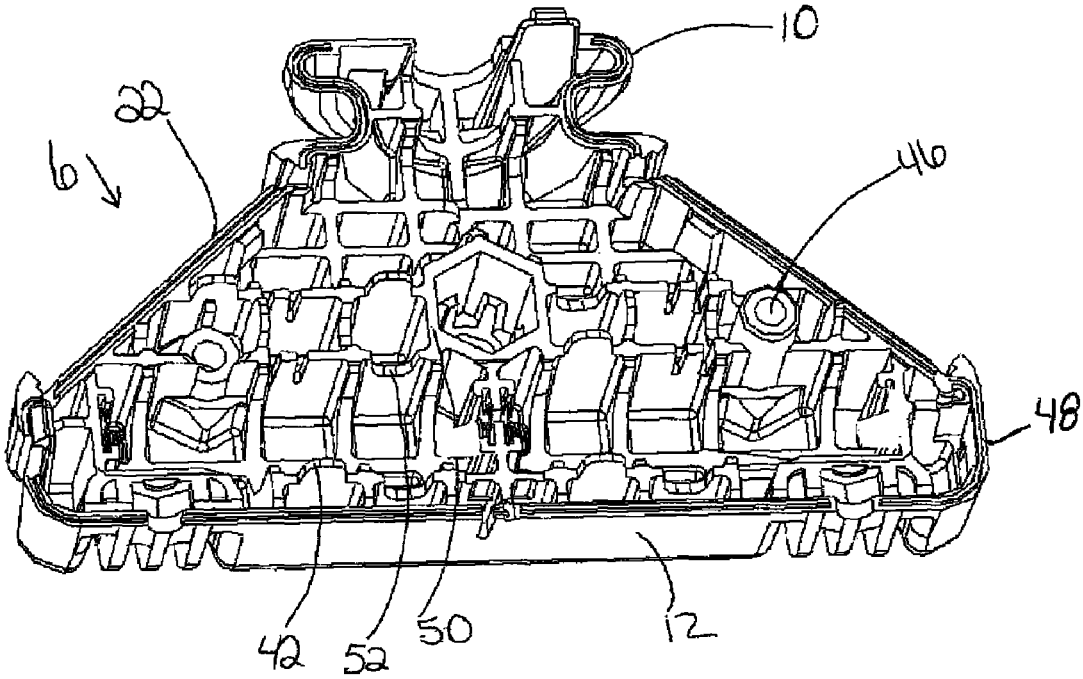
FIG. 5 is a perspective view of a front side of a housing.

It is the particular configuration of the housing 4 that resists applied shearing forces. In particular, the housing 4 resists shearing forces at least due to the mechanical cooperation of a plurality of tabs 42 that extend from the plurality of internal walls 50 with a plurality of notches 52 located in the plurality of internal walls 50 to form a joint 49 (FIG. 4). Specifically, when the front side 6 is mated with the back side 8, the plurality of tabs 42 each mates with its corresponding notch 52 of the plurality of notches 52 such that the front side 6 and the back side 8 are separably joined together and resist laterally sliding with respect to one another when a shear force is applied. FIG. 4 specifically illustrates the mating of a tab 42 with a notch 52. In some particular implementations, at least two of the plurality of tabs 42 may be oriented in a different direction from one another, such as perpendicular to one another.

In some particular implementations, the front side 6 and the back side 8 may comprise symmetrical halves. In other particular implementations, the front side 6 and the back side 8 may comprise asymmetrical sides. In still other particular implementations, the front side 6 and the back side 8 may be identical such that when an internal wall 50 of the front side 6 faces an internal wall of the back side 8, the plurality of tabs 42 and the plurality of notches 52 on the front side 6 and the back side 8, respectively, present a mating-image to one another such that a tab 42 on the front side 6, for instance, corresponds to a notch 52, for example, on the back side 8 (and vice-versa).

Figure 6:
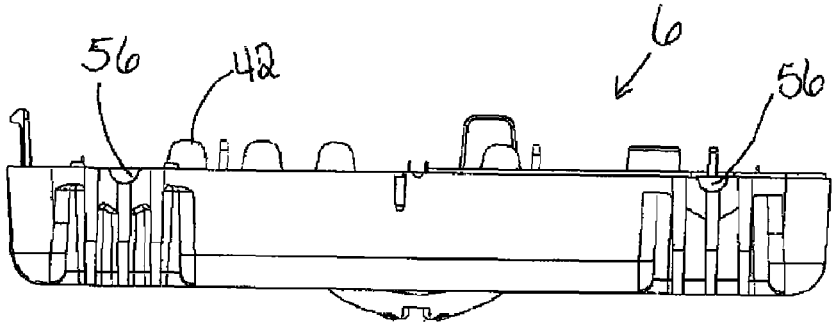
FIG. 6 is a bottom view of a front side of a housing.
Figure 7:
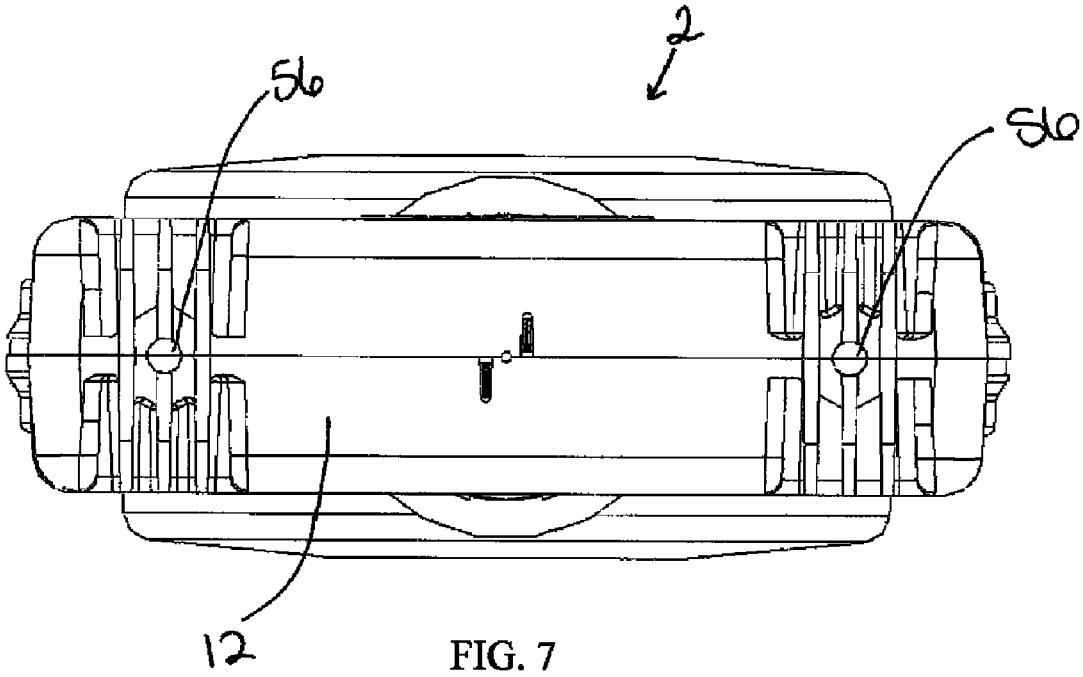
FIG. 7 is a bottom view of the implementation of FIG. 1.
Figure 8:
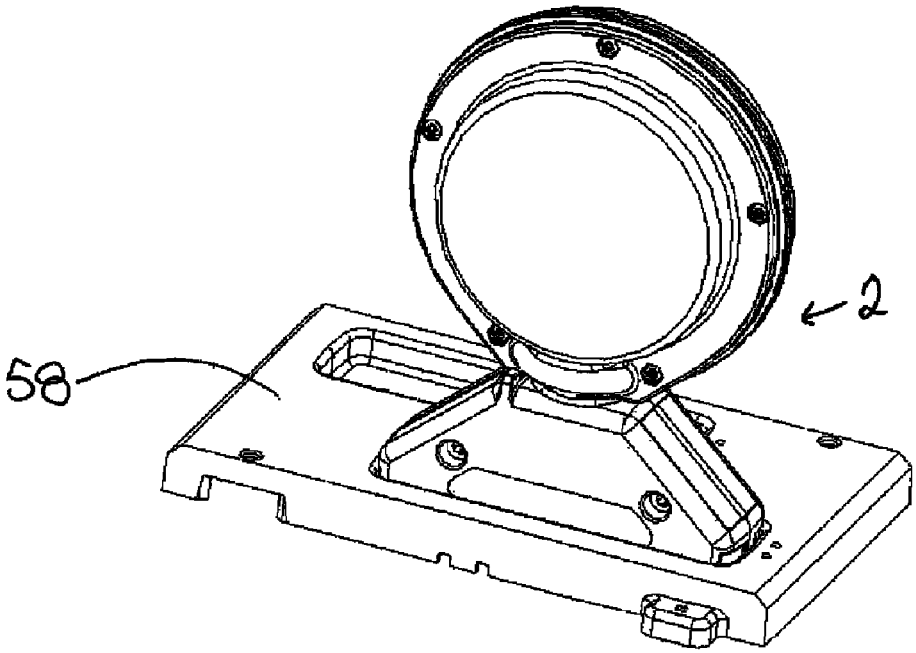
FIG. 8 is a front view of the implementation of FIG. 1 coupled with a charger base.

Turning now to FIGS. 6-8, these figures illustrate various aspects relating generally to chargeability and re-chargeability. In particular, when the traffic barricade light 2 is shipped to a customer or other user, the one or more rechargeable batteries 34 are in an uncharged state. Significantly, when the traffic barricade light 2 is first placed outdoors, it may take some considerable time for the at least two solar panels 32 to charge a rechargeable battery 34 sufficiently for the battery to adequately power the light source 38 throughout the night or in insufficient lighting. Accordingly, one or more charging apertures 56 may be provided in the housing 4 such that the one or more rechargeable batteries 34 may electrically communicate with an external charger base 58. Specifically, the housing 4 may be placed in electrical communication with the charger base such that the one or more rechargeable batteries 34 are charged by the charger base 58 prior to placing the traffic barricade light 2 in the field. While the one or more charging apertures 56 are illustrated as on the bottom side 12 of the housing 4, a charging aperture 56 may be located any place on or in the housing 4. Those having ordinary skill in the art will be able to select appropriate charger base characteristics including size, voltage, current and charge time for use with the particular rechargeable batteries selected for a particular application of this disclosure. Once the one or more rechargeable batteries 34 are provided with an initial electrical charge, the traffic barricade light 2 is ready for first use.

Figure 9:
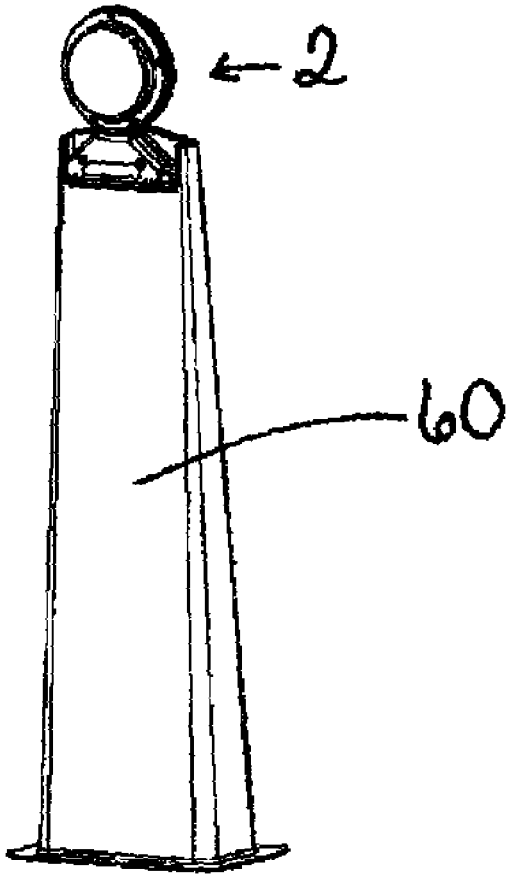
FIG. 9 is a front view of the implementation of FIG. 1 coupled with a barricade.

FIG. 9 illustrates the traffic barricade light 2 coupled with a traffic barricade 60. The traffic barricade 60 may comprise any configuration such as a cone, a saw-horse, a barrel, a pole, a concrete barrier, and/or other support apparatuses. The traffic barricade light 2 may be coupled with the barricade 60 using appropriate tools and hardware, such as bolts, known to those having ordinary skill in the art.

Figure 10:
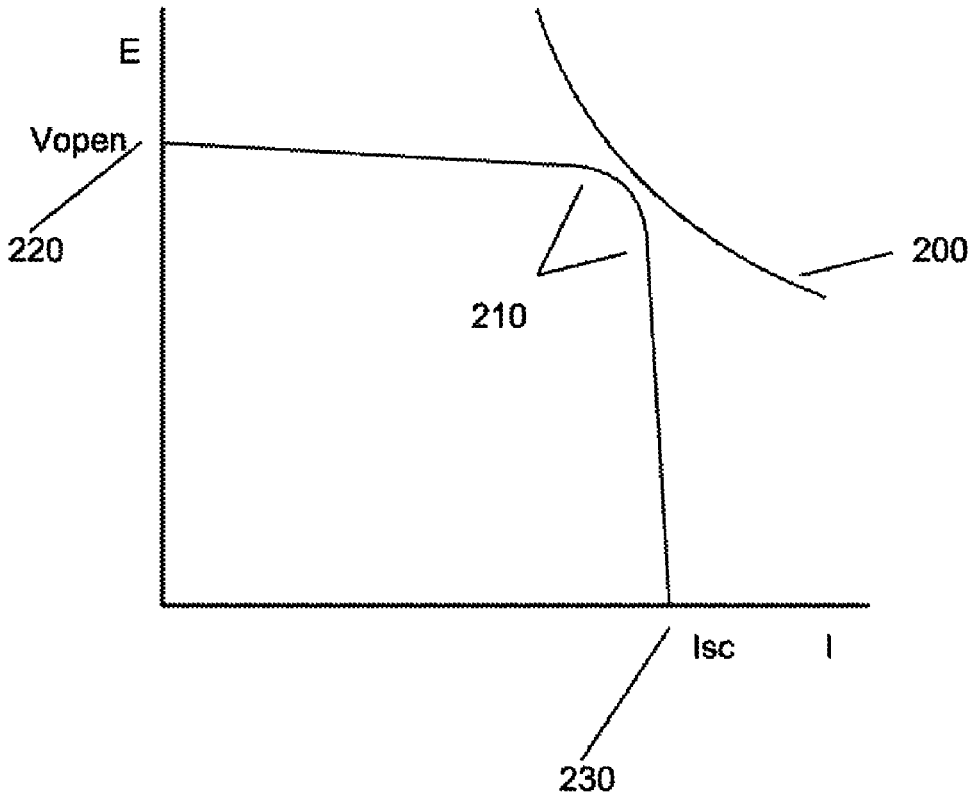
FIG. 10 illustrates a non-limiting example of a solar cell output characteristic.

FIG. 10 illustrates a non-limiting example of a solar cell output characteristic curve. Curve 200 is representative of a constant power curve for the system. At a given illumination, the output voltage of each of the at least two solar panels 32 at 0 Amperes of current is given by the specified Vopen 220. As load current on the solar panel 32 is increased, the output voltage will fall slightly until a region 210 of maximum power is reached. As the load current is further increased, the output voltage of the solar panel 32 will suddenly fall. As the output voltage falls, the output current increases only slightly. When the output voltage falls to 0, the short-circuit current Isc 230 is reached. As described above, at least one of the at least two solar panels 32 will be partially shaded at some time throughout the day, and the at least two solar panels 32, collectively, will operate below their maximum operating point throughout the course of the day. Accordingly, in some particular implementations, a regulator circuit 36 may be provided to regulate the maximum power of the solar panels 32 and the at least one rechargeable battery 34 such that maximum charge energy is achieved regardless of the different charge energy levels of the solar panels 32 with respect to each other at any one time and regardless of the widely varied total charging energy levels of the system throughout the day. A non-limiting example of regulation of charge energy between solar panels and the at least one rechargeable battery is provided in U.S. Pat. No. 4,604,567 to Chetty, the disclosure of which is hereby incorporated by reference.

FIG. 11 illustrates a non-limiting example of a circuit diagram for a particular implementation of a traffic barricade light. As illustrated, the at least two solar panels 32 (the parallel combination of two or more solar panels 32 represented in FIG. 11 by a single symbol) are electrically coupled in parallel with each other via an electrical connector 35. Likewise, each of the at least two solar panels 32 are coupled in parallel with at one another and are additionally coupled with least one rechargeable battery 34 via an electrical connector 35. One or more regulator circuits 36 may be coupled in electrical communication between one or more solar panels 32 and a battery 34 such that the regulator circuit 36 maintains an optimum charge power from the solar panel 32 to the battery 34.

In particular, when energy strikes one or more solar cells 32, a current will flow through resistor 62 and into the base of one or more transistors 64 via the base windings of transformer 66. The output of transformer 66 may be converted to direct current (DC) through one or more output diodes 74. In some particular implementations, voltage generated by the one or more solar cells 32 may not be sufficient to turn on transistors 64. In some particular implementations, transformer 66 may act as an inductor. In addition, in some particular implementations, a control circuit 36 is connected to the battery. The control circuit 36 monitors the state of charge of the one or more batteries 34 and prevents one or more batteries 34 from being overcharged. Specifically, when the battery 34 has reached full capacity, a base of transistor 68 is raised by the control circuit 36 through resistor 70. In particular implementations, transistor 68 clamps a base terminal 65 of the power converter transistors 64. Two or more diodes 72 isolate the base signals from interfering with each other. In some particular implementations, control circuit 36 will charge the battery 34 with a little as 0.25 volts, even if the battery 34 is completely discharged and the battery voltage is 0.0.

Still referring to FIG. 11, resistor 62 sets the base current of the one or more switching transistors 64. When the resistance of resistor 62 is sufficiently large, the circuit may not be completed, and no energy may be converted. In some particular implementations, resistor 62 can limit the power to approximately half of the maximum allowed by the transformer 66. This adjustment may be used to precisely match the effective input characteristics of the converter to the output characteristic of one or more solar cells 32.

It is specifically contemplated that the components included in a particular implementation of a traffic barricade light may be formed of any of many different types of materials or combinations that can readily be formed into shaped objects and that are consistent with the intended operation of a traffic barricade light. For example, the components may be formed of: rubbers (synthetic and/or natural) and/or other like materials; polymers and/or other like materials; plastics, and/or other like materials; composites and/or other like materials; metals and/or other like materials; alloys and/or other like materials; and/or any combination of the foregoing.

Furthermore, the particular barricade lights, housing assemblies, housings, collars, bottom sides, heights, widths, depths, axes, angled walls, opposing shoulders, recesses, passages, compartments, solar panels, rechargeable batteries, regulator circuits, light sources, lenses, interlocking tabs, front sides, back sides, external walls, internal walls, tabs, battery cavities, and implementing components forming a particular implementation of a traffic barricade light may be manufactured separately and then assembled together, or any or all of the components may be manufactured simultaneously and integrally joined with one another. Manufacture of these components separately or simultaneously may involve extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, and/or the like. If any of the components are manufactured separately, they may then be coupled or removably coupled with one another in any manner, such as with adhesive, a weld, a fastener, any combination thereof, and/or the like for example, depending on, among other considerations, the particular material(s) forming the components. By way of non-limiting example, the housing 4 and lens 40 may be formed separately and thereafter coupled together.

It will be understood that particular implementations are not limited to the specific components disclosed herein, as virtually any components consistent with the intended operation of a method and/or system implementation for a traffic barricade light may be utilized. Accordingly, for example, although particular barricade lights, housing assemblies, housings, collars, bottom sides, heights, widths, depths, axes, angled walls, opposing shoulders, recesses, passages, compartments, solar panels, rechargeable batteries, regulator circuits, light sources, lenses, interlocking tabs, front sides, back sides, external walls, internal walls, tabs, battery cavities, and implementing components may be disclosed, such components may comprise any shape, size, style, type, model, version, class, grade, measurement, concentration, material, weight, quantity, and/or the like consistent with the intended operation of a method and/or system implementation a traffic barricade light may be used.

In places where the description above refers to particular implementations of a traffic barricade light, it should be readily apparent that a number of modifications may be made without departing from the spirit thereof and that these implementations may be applied to other traffic barricade lights. The accompanying claims are intended to cover such modifications as would fall within the true spirit and scope of the disclosure set forth in this document. The presently disclosed implementations are, therefore, to be considered in all respects as illustrative and not restrictive, the scope of the disclosure being indicated by the appended claims rather than the foregoing description. All changes that come within the meaning of and range of equivalency of the claims are intended to be embraced therein.

The invention claimed is:

1. A traffic barricade light comprising:

a housing, the housing comprising a collar, a bottom side, a front side, a back side, and a depth, wherein the housing comprises at least two angled walls on opposing shoulders of the housing within the depth at an oblique angle relative to the bottom side of the housing, each angled wall comprising a recess and a passage from the recess to a compartment within the housing, each of the front side and the back side comprising:

a plurality of internal walls extending within the housing from the front side to the back side of the housing; and a plurality of tabs extending from the plurality of internal walls, the plurality of tabs corresponding with a plurality of notches in the plurality of internal walls such that when the front side of the housing is mated with the back side of the housing, wherein the plurality of tabs each mates with its corresponding notch of the plurality of notches;

at least two solar panels, each of the at least two solar panels coupled to an angled wall, wherein the at least two solar panels are electrically coupled in parallel with each other and with at least one rechargeable battery stored within the housing;

a regulator circuit electrically coupled between the at least two solar panels and the at least one rechargeable battery;

a light source electrically coupled to the battery; and a lens coupled to the collar.

2. The traffic barricade light of claim 1, wherein at least two of the plurality of tabs are oriented in a different direction from one another.

3. The traffic barricade light of claim 1, wherein the plurality of internal walls define a battery cavity.

4. The traffic barricade light of claim 1, wherein one of the at least two solar panels is coupled within the recess.

5. The traffic barricade light of claim 1, wherein a lens depth and the housing depth are substantially equal.

6. A housing assembly for a traffic barricade light battery comprising:

a housing comprising a collar, a bottom side, a front side, a back side, and a depth, wherein the housing comprises at least two angled walls on opposing shoulders of the housing within the depth at an oblique angle relative to the bottom side of the housing, each angled wall comprising a recess and a passage from the recess to a compartment within the housing, wherein the front side and the back side each comprise:

an external wall;

a plurality of internal walls extending within the housing from the front side to the back side of the housing; and a plurality of tabs extending from the plurality of internal walls, the plurality of tabs corresponding with a plurality of notches in the plurality of internal walls such that when the front side of the housing is mated with the back side of the housing, wherein the plurality of tabs each mates with its corresponding notch of the plurality of notches.

7. The housing assembly of claim 6, wherein at least two of the plurality of tabs are oriented in a different direction than one another.

8. The housing assembly of claim 6, wherein the housing is separable at a midpoint of the depth.

9. The housing assembly of claim 6, wherein the front side is removably coupled with the back side via at least one fastener passing through both the front side and the back side.

10. The housing assembly of claim 6, wherein the plurality of internal walls define a battery cavity.

11. The housing assembly of claim 6, further comprising at least two solar panels, each of the at least two solar panels disposed within a recess on each of the at least two angled walls.

12. A traffic barricade light comprising:

a housing, the housing comprising a collar, a bottom side, a front side, a back side, a height, a width and a depth, the depth being less than both the height and the width, wherein the housing comprises a recess and a passage from the recess to a compartment within the housing, and wherein each of the front side and the back side comprise;

an external wall;

a plurality of internal walls extending within the housing from the front side to the back side of the housing; and a plurality of tabs extending from the plurality of internal walls, the plurality of tabs corresponding with a plurality of notches in the plurality of internal walls such that when the front side of the housing is mated with the back side of the housing, wherein the plurality of tabs each mates with its corresponding notch of the plurality of notches;

at least two solar panels electrically coupled in parallel with each other and with at least one rechargeable battery stored within the housing;

a light source electrically coupled to the battery; and a lens coupled to the collar.

13. The traffic barricade light of claim 12, wherein at least two of the plurality of tabs are oriented in a different direction than one another.

14. The traffic barricade light of claim 12, wherein the plurality of internal walls define a battery cavity.

15. The traffic barricade light of claim 12, wherein a regulator circuit is electrically coupled between the at least two solar panels and the at least one rechargeable battery.

16. The traffic barricade light of claim 12, wherein the housing comprises at least two angled walls on opposing shoulders of the housing within the depth at an oblique angle relative to the bottom side of the housing.

17. The traffic barricade light of claim 16, wherein the recess is disposed within each of at least two angled walls on opposing shoulders of the housing, the at least two angled walls located within the depth at an oblique angle relative to the bottom side of the housing.

18. The housing assembly of claim 6, wherein a lens depth and the housing depth are substantially equal.

19. The traffic barricade light of claim 1, wherein the housing is separable at a midpoint of the depth.

20. The traffic barricade light of claim 1, wherein the front side of the housing is removably coupled to the back side of the housing via at least one fastener passing through both the front side and the back side.

* * * * *